United States Patent [19]

Bishop

[11] 4,325,057

[45] Apr. 13, 1982

[54] SCHOOL BUS APPROACH NOTIFICATION METHOD AND APPARATUS

[75] Inventor: Michael K. Bishop, Fort Wayne, Ind.

[73] Assignee: Bishop-Hall, Inc., Geneva, Ind.

[21] Appl. No.: 164,014

[22] Filed: Jun. 30, 1980

[51] Int. Cl.[3] ..... G08G 1/12

[52] U.S. Cl. ..... 340/539; 340/23; 455/57

[58] Field of Search ..... 340/23, 24, 52 R, 539; 455/39, 57, 49, 54

[56] References Cited

U.S. PATENT DOCUMENTS

| | | |
|---|---|---|
| 3,020,522 | 2/1962 | Lesher . |
| 3,114,127 | 12/1963 | Ramsey . |
| 3,157,871 | 11/1964 | Umanoff . |
| 3,167,282 | 1/1965 | Hursh et al. |
| 3,416,129 | 12/1968 | Dean . |
| 3,714,574 | 1/1973 | Baba et al. |
| 3,718,899 | 2/1973 | Rollins . |
| 3,818,345 | 6/1974 | Miya et al. |
| 3,828,306 | 8/1974 | Angeloni . |
| 3,906,436 | 9/1975 | Kurauchi et al. |
| 3,922,678 | 11/1975 | Frenkel . |
| 4,023,138 | 5/1977 | Ballin . |
| 4,041,393 | 8/1977 | Reed . |
| 4,165,487 | 8/1979 | Corderman . |

*Primary Examiner*—Alvin H. Waring
*Attorney, Agent, or Firm*—Gust, Irish, Jeffers & Hoffman

[57] ABSTRACT

A system and method whereby school children waiting for the arrival of a school bus are notified of impending arrival of the bus by means of a radio transmitted signal which activates a visual or audio alarm located in their respective residences. A radio frequency transmitter is placed in each school bus, with the transmission frequency selected to correspond to a particular bus route. A radio frequency receiver is placed within a plurality of selected residences along a bus route and tuned to receive the frequency corresponding to that transmitted by the bus following the route followed by the bus which is to stop and pick up children at that residence. When the receiver receives the transmitted signal, an audible or visual alarm is activated thereby notifying the occupants of the residence of the impending arrival of the bus. The sensitivity of each receiver to the transmitted signal is adjustable so that the receiver will not activate its alarm until the bus is a certain distance away, thereby reducing to a minimum the amount of time the children must wait at the bus stop, yet giving them sufficient time to be aware of the approach of the bus. The notification system is intended for use in both urban and rural areas wherein the school buses following different routes will be equipped with transmitters of respective different frequencies, and the various groups of residences are equipped with receivers sensitive to the same respective frequencies, depending on the bus which the children living in the residences are to take.

17 Claims, 6 Drawing Figures

TRANSMITTER

RECEIVER

SCHOOL BUS APPROACH NOTIFICATION METHOD AND APPARATUS

BACKGROUND OF THE INVENTION

The present invention relates to a school bus approach notification system, and more particularly, to such a system utilizing radio frequency transmission for notification.

In both urban and rural areas, it is common practice for school children to ride to school on school buses operated by the city or county school system. Normally, the bus makes stops at selected places along its route, but does not necessarily stop at each residence wherein a child taking that bus lives, due to the increased amount of time which would be necessary to make such numerous stops. Rather, the bus may stop at one or two positions along a block, and it is necessary for the children to congregate at those positions and wait for the arrival of the bus. This is particularly true in urban areas where the sight of children congregating at a corner is a familiar one.

In rural areas, it is not uncommon for the driveways leading from the highway to the homes to be quite long so that, even though the bus may stop at each residence, it is still necessary for the children to walk a considerable distance from the house to the end of the driveway and meet the bus.

Although it is intended that the school buses follow a regular schedule in traveling along their routes so that the children will be able to time their arrival at the bus stop to minimize the waiting time, this is very often not the case. In the event of mechanical problems, the bus can be delayed for a considerable length of time, and it is virtually impossible to notify each of the residences of the delay. Moreover, inclement weather, such as fog and icy streets, can delay the arrival of the bus, and result in the children having to stand out in the weather for considerable periods of time. Even if weather or mechanical problems do not delay the arrival of the bus, the normal fluctuations in schedule makes the exact time of arrival somewhat uncertain, so that parents will tend to send their children to the bus stop earlier than is normally necessary so that there is no chance the bus will be missed. Thus, the children have a moderate wait at the bus stop when the bus is on schedule, and a lengthy wait when the bus is delayed by traffic, weather, mechanical difficulties, or the like. During this wait, the children are subject to health and safety hazards.

SUMMARY OF THE INVENTION

In order to minimize the waiting time at a bus stop, the present invention provides a system wherein a radio frequency transmitter is located in the school bus and a radio frequency receiver is located in the residences, wherein the receivers are responsive only to the transmitted radio frequency of the bus that is traveling on the desired route. The receiver energizes an audio or visual signal to advise the residents that the bus is in the area and that the child should prepare to leave for the bus stop. The transmitters located on the buses transmit only frequencies corresponding to their respective routes and school destinations, and, since a receiver is only responsive to a single transmitted frequency corresponding to the bus which the particular child or children are to take, signals from other buses will not activate the audio or visual signals of that receiver, even though they may travel down the same street or a street in close proximity when following their respective routes. It should be noted that, even though children may live on the same street, they will often attend a number of different schools. For example, older children will attend high school, whereas younger children will attend elementary or middle school. Other children may even be in a completely separate school system, in the case of parochial grade schools and high schools. Thus, it is not uncommon for children living on the same street to attend four or more different schools, and it is very likely that each school will be served by a different school bus, each of which will travel down that street to pick up the children attending the school of its destination.

The notification system of the present invention accommodates a situation of this type very well because each different bus transmits a radio signal of a different frequency or a signal modulated or encoded differently so that only receivers tuned to it will be activated. By selecting the appropriate receiver or tuning the receiver to the appropriate frequency or channel, the receiver will ignore all signals except that to which it is tuned, and the occupants of the residence will be notified only of the arrival of the appropriate bus.

Each receiver is provided with a sensitivity control which renders the receiver non-responsive to energize the audio or visual signal until the bus transmitter is at a predetermined distance from the residence. By adjusting the sensitivity control such that the receiver is more or less sensitive to the transmitted signal, more or less advance notice, respectively, is given of the bus arrival. This enables children that are further from the bus stop or take more preparation time to depart for the bus stop to increase the sensitivity of their receivers to provide an earlier notification of bus approach. On the other hand, children who live close to the bus stop or who normally do not require a long preparation time, can decrease the sensitivity so that notification will not be received until the bus is very near the bus stop, thereby minimizing the wait. By appropriately adjusting the sensitivity of the receiver, waiting time at the bus stop can be reduced to a minimum.

The transmitters preferably have a plurality of manually selectable frequencies for the transmitted signal, wherein each frequency corresponds to a different bus route. After selecting the appropriate frequency, the driver need do nothing more in terms of notifying children along his route of his arrival, and is able to devote his entire attention to operation of the bus. Characteristics of the transmitted signal other than frequency may be varied to distinguish between bus routes, and may include different audio modulation pulses that may be selectively filtered at the receivers, or different coded signals that may be appropriately decoded at the receivers.

The system of the present invention can be easily integrated into the existing school bus system. After determining which families have children taking a particular bus, those families will be given or rented receivers sensitive only to the frequency to be transmitted by that bus. In order to avoid errors, the receivers may be of the crystal controlled type wherein a crystal of the appropriate frequency is installed. Thus, the receiver cannot be inadvertently tuned to an incorrect frequency.

The advantages of the present system are numerous. Not only will children not have to wait outside in inclement weather, but the time which they must spend on the shoulder of a highway or the curb of a busy street is minimized, thereby reducing the incidence of illness and accidents. With an accurate early notice, more parents would be able to utilize the school bus system, thereby reducing the expenditure of gasoline and time necessary to drive the children to school. An adjustable range sensitivity control on each receiver will permit the notification of arrival to occur at an earlier time, thereby permitting the receivers to be adjusted to afford more time during the winter months for the children to dress.

In the event of mechanical failure thereby resulting in delay of the bus, the children will not be required to stand at the stop for extended periods of time. Moreover, with a frequency selector on the transmitter, the bus driver may easily change frequencies in the event that he covers the route normally followed by the disabled bus. With the notification system of the present invention, the children will be more prompt at meeting the bus thereby reducing waiting time of the bus at the stop. Not only will this reduce the consumption of fuel, but it will reduce the amount of time which traffic will be held up by the waiting bus.

Specifically, the present invention relates to a school bus approach notification system for use in a geographical area having at least one school, a plurality of residences, a school bus following a given bus route, or a plurality of buses following respective routes. A radio transmitter is placed in the school bus and has first means for transmitting at least one radio frequency signal, each signal having an identifying characteristic; and a plurality of radio receivers each of which is placed within one of the residences and has second means for tuning the receiver to receive the transmitted signal and for producing an output signal in response to a signal having a predetermined characteristic. Either the transmitter or receiver has third means for determining the distance between the transmitter and receiver at which the receiver first responds to the transmitted signal to produce the output signal, and fourth means are provided for coupling to the second means and responsive to the output signal for producing either or both of a visual and audio approach notice signal whereby the fourth means produces the notice signal only when the transmitter is at or less than said distance from the receiver to provide advance notice at the residence of the expected arrival time of the bus.

Preferably, there are provided a plurality of buses and a plurality of bus routes wherein the transmitter first means for each bus comprises means for providing each bus with a transmission characteristic corresponding to the bus route traveled whereby the transmitter on the bus on each route transmits a given assigned characteristic different than the characteristic assigned for every other route, and the receiver at each residence on a given route comprises means for distinguishing the transmission characteristic for that route from the transmission characteristics for all other routes and produces an output signal only upon receiving a transmission having a characteristic for that route.

The present invention also relates to a method of school bus approach notification wherein a school bus travels on a given bus route to a school, and stops at bus stops for the boarding of school children from residences along the bus route. The method comprises the steps of transmitting from the bus a radio frequency signal having a bus route identifying characteristic, receiving at one or more residences serviced by the bus a transmitted signal having the identifying characteristic and rejecting all other signals, and actuating at a given residence a notice signal upon reception of a signal having the identifying characteristic when the bus is a predetermined distance from the given residence. Preferably, there are a plurality of bus routes and the transmitted signal from a bus on a given bus route has an identifying characteristic which distinguishes it from all buses traveling on different routes.

It is an object of the present invention to provide a school bus approach notification method and apparatus that is effective to notify waiting school children of the approach of the bus on a particular bus route.

It is another object of the present invention to provide a method and apparatus for notifying school children of the impending arrival of a school bus wherein the receivers on a given route are tuned to receive only one frequency and include a sensitivity control to give notice at the residence when the approaching bus is at a distance from the receiver corresponding to the sensitivity adjustment.

Yet another object of the present invention is to provide in the system described above transmitters having a plurality of selectable transmission radio frequencies, each frequency corresponding to a particular bus route.

Yet another object of the present invention is to provide transmitters and receivers which are easily portable so that transmitters may be moved from bus to bus and receivers may easily be distributed to the appropriate residences at the beginning of the school year and collected at the end of the school year.

These and other objects of the present invention will become apparent from the following detailed description considered together with the accompanying drawings.

DETAILED DESCRIPTION OF A PREFERRED EMBODIMENT

Figure 1:
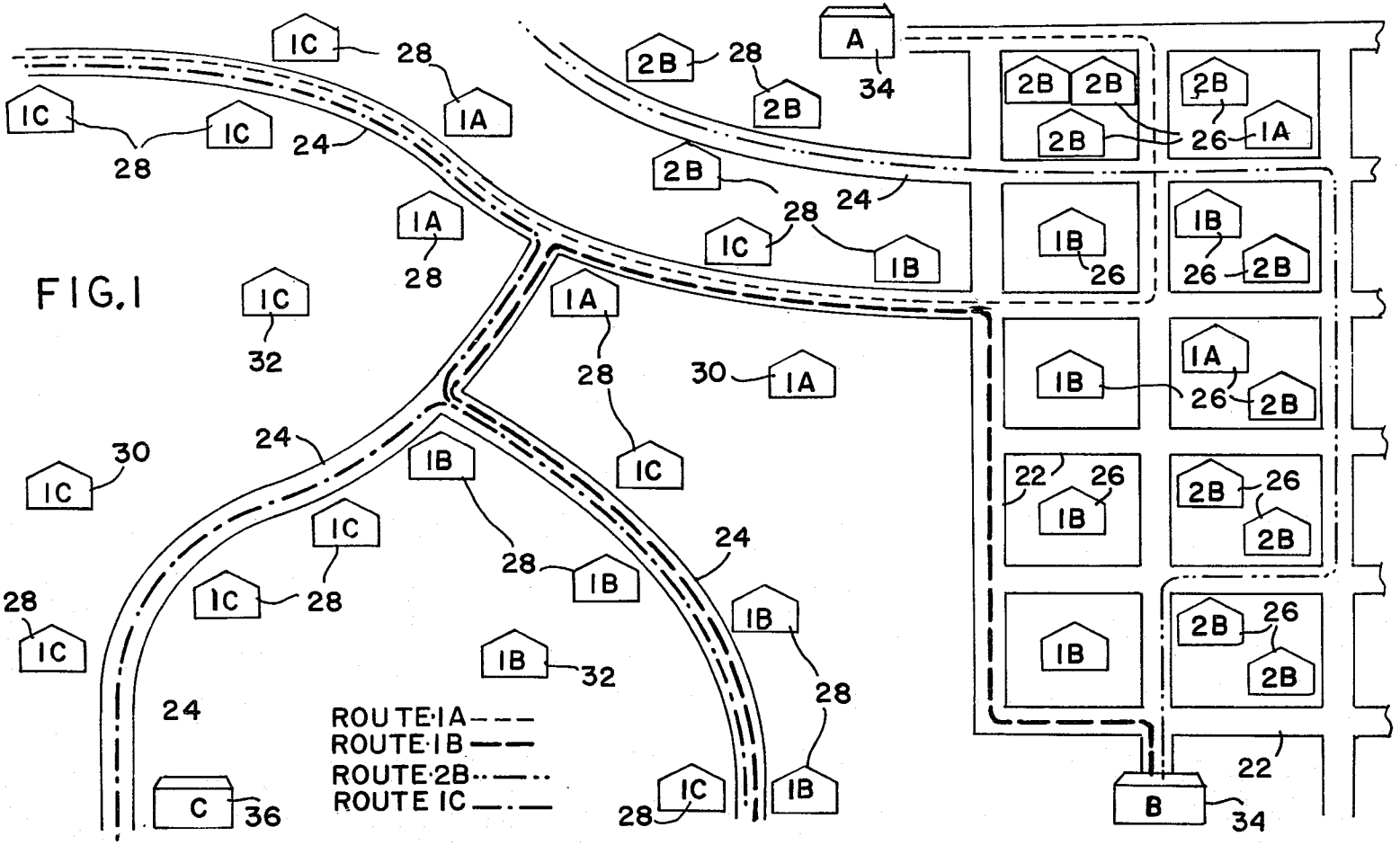
FIG. 1 is a diagrammatic map of a given community having rural and urban regions, and including a plurality of bus routes terminating at a plurality of schools.

Referring to FIG. 1, there is illustrated streets 22 arranged in a block or grid pattern as is typical in an urban community, and a series of diverging roads 24, as is typical in a rural community. Houses 26 are located along streets 22 in the urban area, and houses 28 are located along roads 24 in the rural area. In the rural area, it will be noted that certain of the houses 30 are located at distances from their respective roads which are greater than the distances from the roads at which houses 28 are located, and houses 32 are located at a even greater distance. This is typical of rural communities wherein certain houses are located in close proximity to the roads, whereas other houses are connected by long driveways. Schools 34, designated A and B are located respectively at the upper and lower extremities of streets 22, and school 36, which is designated as school C, is located at the lower extremity of roads 24.

Bus route 1A, represented by a dotted line on roads 24 and streets 22, terminates at school A; bus route 1B, represented by a dashed line, terminates at school B; but route 2B, represented by a dash dot dot line, terminates at school B; and bus route 1C, represented by a dash dot line, terminates at school C. The residents of houses designated 1*a* use buses on route 1A to transport their children to school A; the residents of houses designated 1*b* use buses on route 1B to transport their children to school B; the residents of houses designated 1*c* use buses on route 1C to transport their children to school C; and the residents of houses designated 2*b* use buses on route 2B to transport their children to school B.

It will be noted that routes 1A and 1C, although terminating at schools A and C, respectively, travel over identical roads for part of their routes, as in the case of the residences located at the upper left corner of FIG. 1. The same is true with respect to routes 1B and 1C, and routes 1A and 1B. Furthermore, in the case of the urban area, as many as three school buses pass along routes which are in close proximity to each other, although along different streets.

Figure 2:
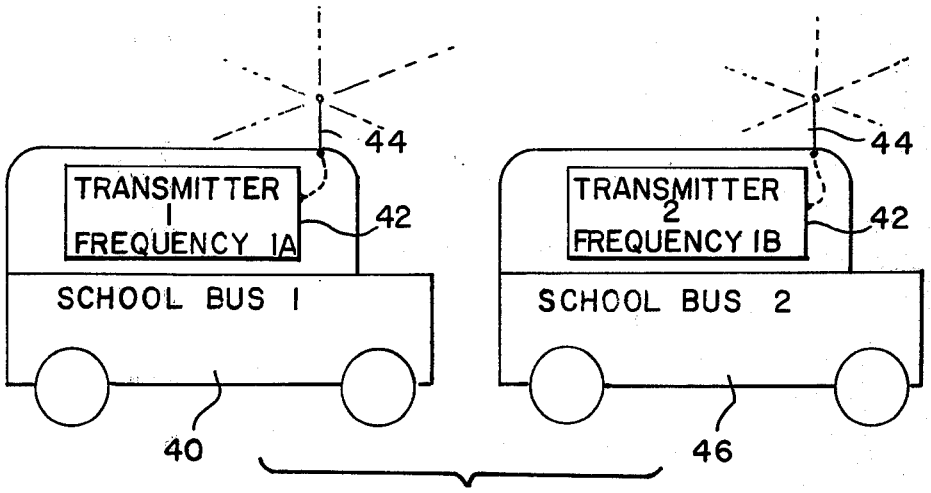
FIG. 2 is a diagrammatic view of two school buses having transmitters transmitting signals of different frequencies.

Referring to FIG. 2, school bus 40 travels route 1A and has a radio transmitter 42 with antenna 44, and transmits on radio frequency RF1. Bus 46, which is also illustrated in FIG. 2, also has a transmitter 42 with an antenna 44, and transmits on frequency RF2. There are also buses (not shown) for routes 2B and 1C, each having a radio transmitter 42 transmitting on frequencies RF3 and RF4, respectively.

Each transmitted frequency may be modulated with an audible tone of 2000 Hertz, for example, as later described. Thus, the buses traveling along each of the routes 1A, 1B, 2B and 1C transmit a radio frequency RF1, RF2, RF3 and RF4, respectively, that is characteristic of the route traveled, and identifies the bus as traveling on that route. Identifying the route traveled is significant because the buses on different routes may travel the same streets during certain portions of their routes, and by identifying the desired route, the school designation is also identified. Furthermore, residences 26 on adjacent or closely proximate streets 22 in the urban region are likely to be subject to signals transmitted from all of the buses traveling on routes in that region, although the precise streets traveled by the respective buses are different.

Each transmitter 42 has an on-off switch 46, a frequency selector 48 having five positions RF1, RF5 to select a given transmission frequency so that one transmitter may be used on any bus, and a power supply 50, which is typically the battery for the engine of the bus. Transmitters 42 may be portable so as to facilitate transfer from one bus to the other, or they may be permanently installed.

Figure 6:
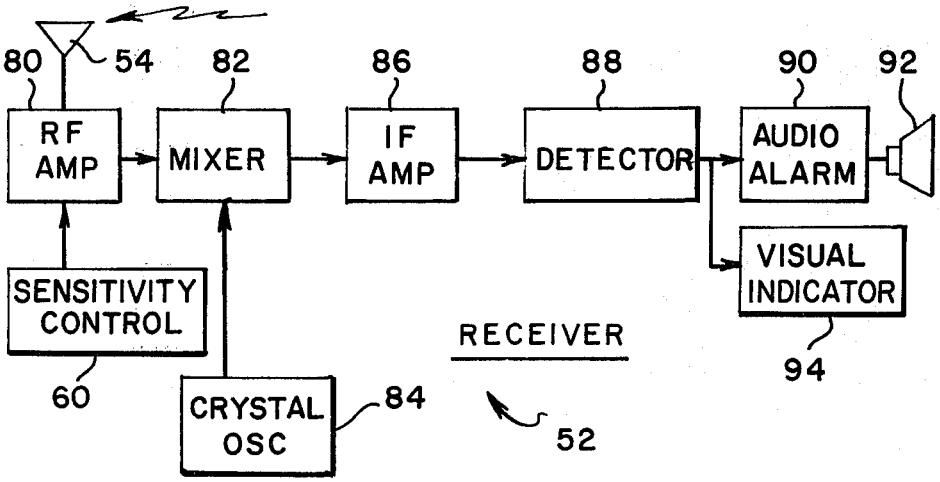
FIG. 6 is a schematic block diagram of the receiver.
Figure 4:
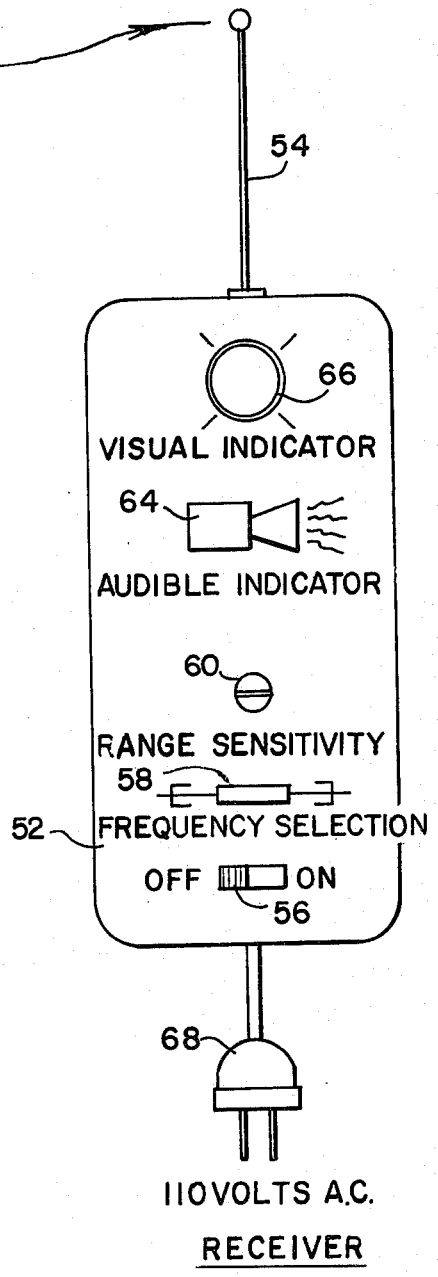
FIG. 4 is a front view of one of the receivers.

Each house 26, 28, 30 and 32 has a receiver 52, illustrated in FIGS. 4 and 6, which is tuned to receive the frequency of the bus which the children of that residence use, as previously described. Thus, houses designated 1*a*, 1*b*, 2*b* and 1*c* have receivers 52 tuned to receive radio frequencies RF1, RF2, RF3 and RF4, respectively. In this manner, each home will effectively receive only the transmitted signal from the bus traveling the specific route utilized by the residents to transport their children to school.

Receiver 52 (FIG. 4) has an antenna 54, which may be placed exteriorly of the home for better reception in weak reception area. Receiver 52 also includes an on-off switch 56, and crystal 58 inserted in receptor 58*a*, wherein crystal 58 is removable from receptor 58*a* so that interchangeability between crystals 58 and receivers 52 is possible. This enables receiver 52 to be tuned to a plurality of different frequencies determined by the respective crystals 58. Range sensitivity control 60 may be adjusted to activate the receiver only when the transmitted signal is sufficiently strong for the adjusted setting. Because the transmission is generally omnidirectional, the further the receiver is from the transmitter, the weaker the received signal. This fact enables the receiver to be adjusted so that it is responsive only to incoming signals at or above a given level, which level bears a direct relationship to the distance of the transmitter 42 from the receiver 52. Audio indicator 64, which sounds an audible alarm, such as a 2,000 Hertz tone, when the receiver 52 receives a transmitted signal above a threshold level, is provided. Alternatively, or in addition thereto, a visual signal, such as a blinking or steady light, is provided to give visual notification to those having hearing deficiencies or where an audible indication is undesirable. A standard plug 68 connects receiver 52 to a conventional electrical receptacle in the home, and serves as the power supply. Alternatively, receiver 52 may be battery operated for greater portability.

Figure 5:
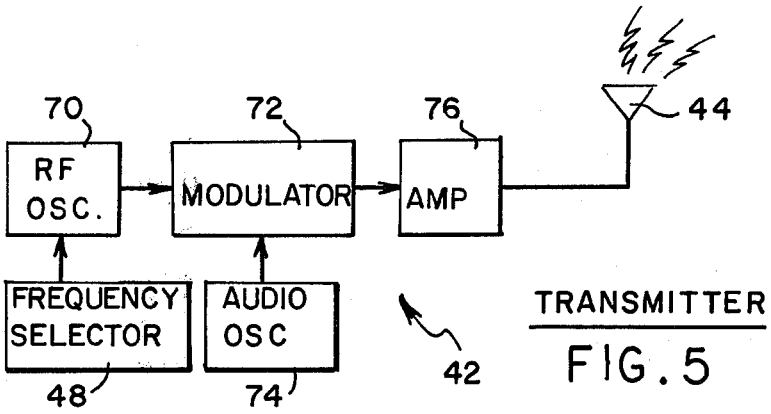
FIG. 5 is a schematic block diagram of the transmitter.
Figure 3:
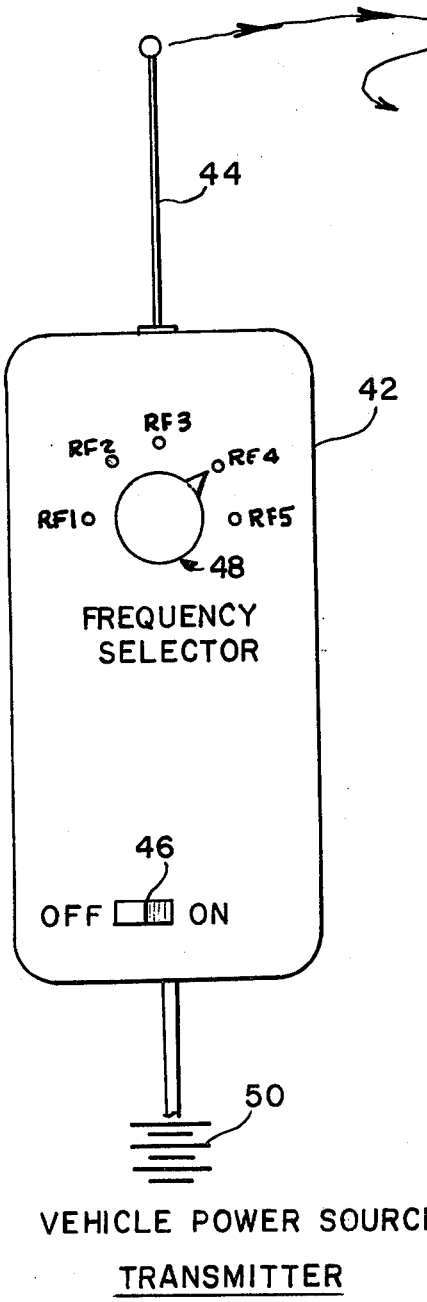
FIG. 3 is a front view of one of the transmitters.

Referring now to FIGS. 5 and 6, block diagram circuits for transmitter 42 and receiver 52 are illustrated. Transmitter 42 comprises a frequency selector 48, which may take the form of a plurality of crystals, such as crystals 58 selectively connected into the oscillator circuit of RF oscillator 70 by means of a selector switch, such as that shown in FIG. 3. RF oscillator 70, which is controlled by frequency selector 48, generates radio frequencies RF1–RF5, depending on the setting of selector 48. Modulator 72 is connected to and receives a signal from RF oscillator 70, which is modulated by an audio frequency signal generated by oscillator 74. The audio signal generated by oscillator 74 may be an audio range tone, such as a tone of 2,000 Hertz, or any other audio frequency. Amplifier 76 is coupled to and receives the modulated radio frequency from modulator 72, and amplifies the signal and couples it to antenna 44 for transmission.

Receiver 52 includes a receiving antenna 54 coupled to radio frequency amplifier 80, which is of the variable gain type. Sensitivity control 60 adjusts the gain of RF amplifier 80 so that the output of amplifier 80 has an amplitude which is a function of the strength of the incoming signal over antenna 54 and the gain of amplifier 80. A relatively low sensitivity setting of control 60 will cause the output of amplifier 80 to have a relatively low amplitude for an input signal of a given strength, whereas increasing the sensitivity selected by control 60 so as to increase the gain of amplifier 80 would result in the same input signal having a substantially higher amplitude. As discussed earlier, the amplitude of the incoming signal is dependent on the distance of transmitter 42 from receiver 52, so that by adjusting the gain of amplifier 80, the distance of receiver 52 from transmitter 42 at which the signal within receiver 52 will be at a sufficiently high level to effectively actuate the audio or visual indicators can be adjusted. For example, for a residence close to the bus route, such as homes 26 and 28, a shorter distance notice may be desired and the sensitivity would therefore be decreased. For homes 30 and 32, which are a greater distance from the routes, a longer distance notice would be desired, so that the sensitivity and gain of amplifier 80 would be increased.

Mixer 82 is connected to the output of RF amplifier 80 and mixes the output signal thereof with the output of a crystal controlled oscillator 84 to provide a demodulated difference signal on the input of IF amplifier 86, as is commonly done in amplitude modulated systems. The frequency of crystal controlled oscillator 84 is determined by the crystal 58 which is received within receptor 58*a*. The frequency of oscillator 84 is selected so that its difference with the desired radio frequency signal RF1–RF4 is equal to the IF frequency of amplifier 86. Thus, by properly selecting the frequency of oscillator 84, the single desired frequency from the group of radio frequencies RF1–RF5 will be amplified and other frequencies will be rejected. Crystal controlled oscillator 84 may be provided with replaceable crystals of frequencies that, upon mixing, will provide the IF frequency of amplifier 86 for each of radio frequencies RF1–RF4.

Detector 88 is coupled to IF amplifier 86 and detects the signal therefrom to provide audio alarm 90 with the transmitted audio signal, which is reproduced by speaker 92. In order to adjust the sensitivity of receiver 52, the gain of RF amplifier 80 is reduced so that the signal received by audio alarm 90 and reproduced through speaker 92 will not reach a trigger level until the incoming signal strength is sufficiently great. This will not occur until the transmitter, and therefore, the bus 40 or 46 is within the desired distance of receiver 52. Threshold level circuits, such as those used in automatic garage door openers, are preferably utilized so that no sound will be produced until a certain signal strength is received.

A visual indicator 94 is coupled to the output of detector 88 to provide a visual signal such as a flashing or steady light. Visual indicator 94 may be provided with a threshold alarm whereby no indication at all is received until the signal at its input has reached a certain level, as in the case of a gas discharge blow tube. Alternatively, a light bulb which becomes brighter as the current increases could be utilized.

A system is thus provided which initiates an audible and/or visual announcement signal, when a bus traveling on a particular bus route is within a predetermined distance of the home, so that the school children may leave their homes and arrive at the bus stop just prior to the arrival of the bus. The predetermined distance is selectable to provide an earlier or later signal, depending on the amount of time which is necessary for the children to leave their home and arrive at the bus stop.

Although a specific transmitter 42 and receiver 52 have been illustrated, the present invention is not so limited. For example, although the present invention has been described in terms of an amplitude modulated transmitter and receiver system, frequency modulation, PCM and other modulation systems could be used. Furthermore, the activation of the receiver could be accomplished by a transmitted code, as is presently customary in the transmitters and receivers of garage door opener systems, or by an unmodulated radio signal.

While this invention has been described as having a preferred design, it will be understood that it is capable of further modification. This application is, therefore, intended to cover any variations, uses, or adaptations of the invention following the general principles thereof and including such departures from the present disclosure as come within known or customary practice in the art to which this invention pertains and fall within the limits of the appended claims.

What is claimed is:

1. A school bus approach notification system employed in a geographical area having a school, a plurality of residences, a bus route extending in close proximity to said residences, and a school bus, said system comprising:

a radio wave transmitter mounted in said bus and having first means for transmitting at least one radio frequency signal, said signal having an identifying characteristic, a plurality of radio receivers located, respectively, in said plurality of residences, each receiver having second means for tuning said receiver to receive said transmitted signal and for producing an output signal in response to said transmitted signal having said predetermined characteristic, said receiver having third means for determining the distance of reception of said transmitted signal between said transmitter and receiver at which said receiver first responds to said transmitted signal to produce said output signal, and fourth means coupled to said second means and responsive to said output signal for producing at least one of visual and audio approach notice signals whereby said fourth means will produce a notice signal only when said transmitter is at or less than said distance from said receiver to provide advance notice at the respective residences of the approach of said bus.

2. The system of claim 1 wherein there are a plurality of said buses and a plurality of said bus routes, the transmitter first means for each said bus comprising means for providing each bus with a transmission characteristic corresponding to the bus route traveled by the respective bus whereby transmitters on buses on each route transmit a given assigned characteristic different than the characteristic assigned for every other route, the receiver second means for each said residence on a given route comprising means for distinguishing the transmission characteristic for that route from the transmission characteristics for all other routes and producing its respective said output signal only upon receiving a transmission having a characteristic for that route.

3. The system of claim 2 wherein said first means comprises generator means for providing a plurality of signals, each signal having a different transmission characteristic, and means for manually selecting one of said plurality of signals.

4. The system of claim 1 wherein said fourth means produces both a visual and audio arrival signal.

5. The system of claim 1 wherein said identifying characteristic is the frequency of the radio signal.

6. A method of school bus approach notification wherein a plurality of school buses travel a plurality of routes, respectively, to one or more schools stopping at bus stops for the boarding of school children from residences along the bus routes, comprising the steps of:

transmitting from each bus a radio signal which has an identifying characteristic distinguishing that bus from all the other said buses traveling different routes, providing at each of a plurality of residences serviced by the buses a receiver which receives and is responsive to the reception of any one of the transmitted signals but rejects all of the other transmitted signals, the residences being exposed to at least some of said transmitted signals and being grouped according to bus routes whereby the receivers of any group of residences are responsive to a said signal different from the signals to which the receivers of the other groups are responsive, the receiver at each residence giving a humanly perceptible notice signal to the occupants of the residence in which it is located in response to the signal received by it and to which it is responsive when the bus is a given distance away from the residence in which it is located, whereby the occupants of the various residences are alerted to the approach of only that bus which is to be taken by the children of the respective residence.

7. The method of claim 6 wherein each receiver is responsive to the signal received by it only if the strength of the received signal exceeds an adjustable predetermined level, and including the step of adjusting said level at a receiver to correspond to a desired given distance between the bus transmitting a said signal and the receiver receiving and responsive to that signal.

8. The method of claim 7 wherein said level is adjusted by adjusting the sensitivity of the respective receiver.

9. The method of claim 6 wherein the identifying characteristic of each transmitted signal is the frequency of that signal.

10. The method of claim 6 wherein the humanly perceptible signal is an audible signal.

11. The method of claim 6 wherein the humanly perceptible signal is a visual signal.

12. The method of claim 11 wherein the humanly perceptible signal is also audible.

13. A bus approach notification system employed in a geographical area having a plurality of residences, a plurality of buses traveling a plurality of routes, respectively, running in proximity to the residences, said system comprising:

a radio transmitter installed in each bus, each transmitter having means for transmitting a radio signal having an identifying characteristic distinguishing that bus from all of the other of said buses traveling different routes, a radio receiver located at each of a plurality of residences serviced by the buses including means for receiving any one of the transmitted signals while rejecting all of the other transmitted signals, the residences being exposed to at least some of the transmitted signals and being grouped according to bus routes whereby the receivers of any group of residences are responsive to a transmitted signal different from the signals to which the receivers of the other groups are responsive, the receiver at each residence including means for producing a humanly perceptible notice signal to the occupants of the residence in which it is located in response to the signal received by it and to which it is responsive when that signal has a strength above a predetermined level at the receiver, whereby the occupants of the various residences are alerted to the approach of only that bus which is to be taken by an occupant of that residence.

14. The system of claim 13 wherein each receiver includes means for adjusting its sensitivity to the signal received by it.

15. The system of claim 13 wherein said means for producing a humanly perceptible signal includes means for producing an audible signal.

16. The system of claim 13 wherein said means for producing a humanly perceptible signal includes means for producing an audible signal.

17. The system of claim 13 wherein said means for producing a humanly perceptible signal includes means for producing audible and visual signals.

* * * * *